United States Patent [19]

Takahashi

[11] Patent Number: 4,633,753

[45] Date of Patent: Jan. 6, 1987

[54] MUFFLER MECHANISM FOR A PIANO

[75] Inventor: Horoyoshi Takahashi, Shizuoka, Japan

[73] Assignee: Nippon Gakki Seizo Kabushiki Kaisha, Japan

[21] Appl. No.: 733,974

[22] Filed: May 14, 1985

[30] Foreign Application Priority Data

May 15, 1984 [JP] Japan ..... 59-69793[U]
Apr. 17, 1985 [JP] Japan ..... 60-80346[U]

[51] Int. Cl.[4] ..... G10C 3/26
[52] U.S. Cl. ..... 84/220
[58] Field of Search ..... 84/220

[56] References Cited

U.S. PATENT DOCUMENTS

| | | | |
|---|---|---|---|
| 396,698 | 1/1889 | Keller | 84/220 |
| 513,341 | 1/1894 | Quint | 84/220 |
| 1,540,739 | 6/1925 | Jefferson et al. | 84/220 |
| 3,640,171 | 2/1972 | Giglio | 84/216 |

*Primary Examiner*—Lawrence R. Franklin
*Attorney, Agent, or Firm*—Ostrolenk, Faber, Gerb & Soffen

[57] ABSTRACT

A muffler mechanism for a piano includes at least one axially rotatable muffler pipe arranged below and extending over an array of strings and a flexible muffler coupled to the muffler pipe and registable at an operative position suited for damped performance, thereby enabling a simple construction, a reduced mounting space and stable and reliable damping effect without deformation even after long use.

11 Claims, 3 Drawing Figures

MUFFLER MECHANISM FOR A PIANO

BACKGROUND OF THE INVENTION

This invention relates to a muffler mechanism used for damping sounds to be generated on a grand piano.

For damped performance on a grand piano, it is conventionally employed to move the keys with the action assemblies sideways in order to reduce the number of strings to be striken by hammers. For example in the case of strings in the treble range, only two out of three strings are striken for damped performance. With this conventional construction, however, a large space has to be reserved for the lateral movement of the keys and the action assemblies. Use of a pedal and a lever mechanism for this purpose connects to a complicated construction and increased parts number.

In order to avoid such drawbacks, Japanese Patent Publication No. Sho.45-22294 proposes a new construction in which, like on an upright piano, a muffler is selectively interposed between an array of strings and an array of hammer in order to damp striking by the hammers. With this earlier proposal, however, the muffler has to be arranged in front of the striking positions on the strings whilst requiring a large space for mounting. Such arrangement seriously interferes with adjustment of the action assemblies. Back and front movement of the horizontally arranged muffler necessitates some extent of rigidity of the muffler which unavoidably lowers the damping effect. Despite such extent of rigidity, the horizontally arranged muffler is vulnerable to deformation. Horizontal movement of the muffler requires a complicated construction of its drive mechanism.

SUMMARY OF THE INVENTION

It is the object of the present invention to provide a muffler mechanism of a simple construction and requiring reduced space for mounting without impairing its damping effect.

In accordance with the present invention, at least one axially rotatable muffler pipe is arranged below an array of strings whilst extending in the width direction of a piano and a muffler is attached to the muffler pipe for movement between an inoperative position for normal performance and an operative position for damped performance which is located between the array of the strings and an array of hammers.

DESCRIPTION OF THE PREFERRED EMBODIMENTS

Figure 1:
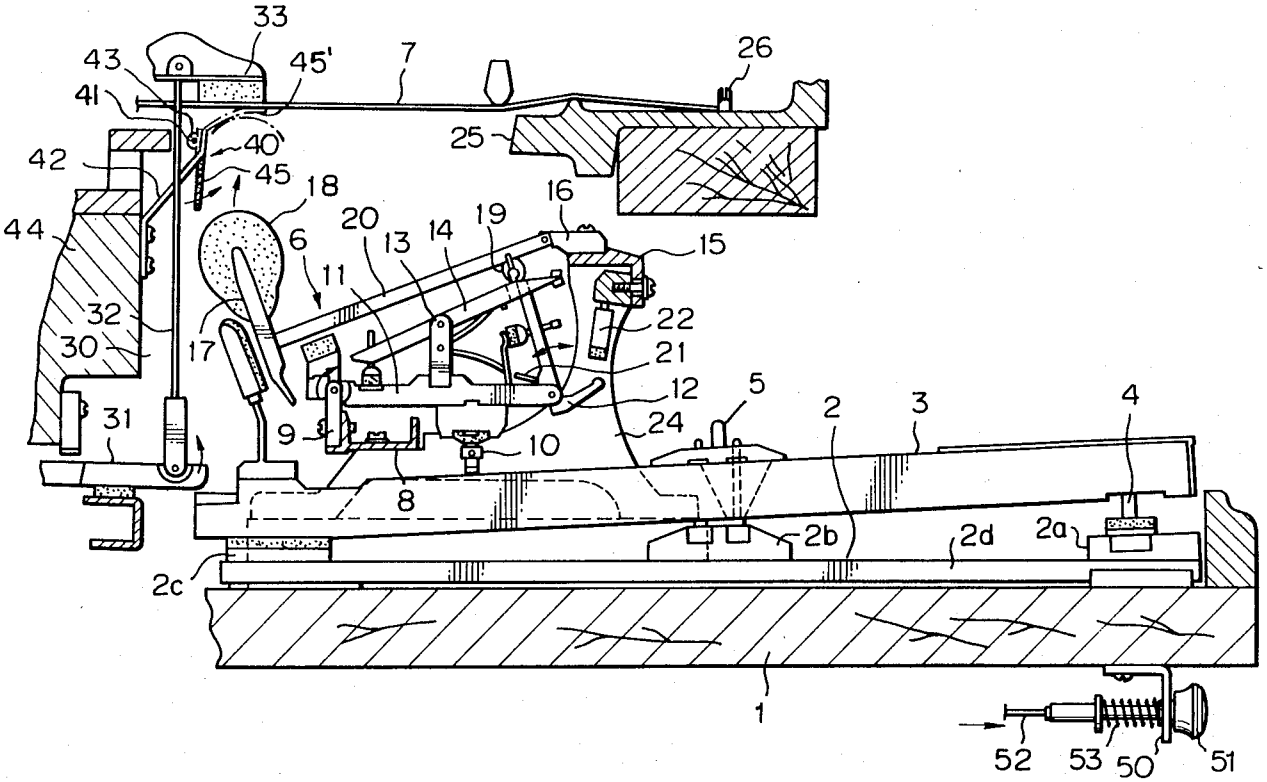
FIG. 1 is a side view, partly in section, of an action assembly and its related part provided with one example of the muffler mechanism in accordance with the present invention.

The action assembly and its related parts of a grand piano provided with the muffler mechanism in accordance with the present invention is shown in FIG. 1, in which a key frame 2 is arranged on a key bed 1 and a key 3 is arranged on the key frame 2. The key frame 2 is made up of a front rail 2*a*, a balance rail 2*b*, a back rail 2*c* and a key bottom 2*d* for connecting these rails. A front pin 4 is arranged on the front rail 2*a* in order to block the key 3 against lateral turning, and a balancing pin 5 is arranged on the balance rail 2*b* which holds the middle of the key 3 in a vertically turnable fashion.

Over the rear end of the key 3 is arranged a known action assembly 6 facing an associated string 7. The action assembly 6 includes a wippen 11 which is pivoted at one end to a wippen rail 8 via a flange 9 and tossed by a capstan when the key 3 is depressed, a jack 12 pivoted to the free end of the wippen 11, a repetition lever 14 pivoted to the top end of a flange 13 mounted on the wippen 11, a hammer shank 20 pivoted at one end to a shank flange rail 15 and arranged, via a hammer roller 19, above the repetition lever 14, a hammer felt 18 attached to the free end of the hammer shank 20 via a hammer wood 17 and a repetition spring 21 for urging the jack 12 and the repetition lever 14 on return movement. The wippen rail 8 and the shank flange rail 15 are both arranged on a action bracket 24 on the key frame 2. A regulating button 22 is also arranged on the shank flange rail 15.

The jack 12 moves upwards with the repetition lever 14 and tosses the hammer roller 19. During this movement, the jack 12 touches the regulating button 22 and is turned clockwise in the drawing and the repetition lever 14 is provisionally disengaged from the lower end of the hammer roller 19. When the hammer roller 19 is tossed by the jack 12, the hammer shank 20 turns upwards so that the hammer felt 18 should strike the associated string 7 which is arranged in tension between a turning pin 26 and a frame pin (not shown).

A known damper assembly 30 is arranged behind the key 3 for movement in association with key depression. The damper assembly 30 is adapted for restricting free vibration of the associated key 7, and made up of a damper lever 31, a damper wire 32 pivoted at the lower end to the front end of the damper lever 31, and a damper 33 mounted atop the damper wire 32. At key depression, the damper lever 31 is tossed by the rear end of the associated key 3 and the damper wire 32 thereupon moves upwards in order to drive the damper 33 out of engagement with the associated string 7.

Figure 2:
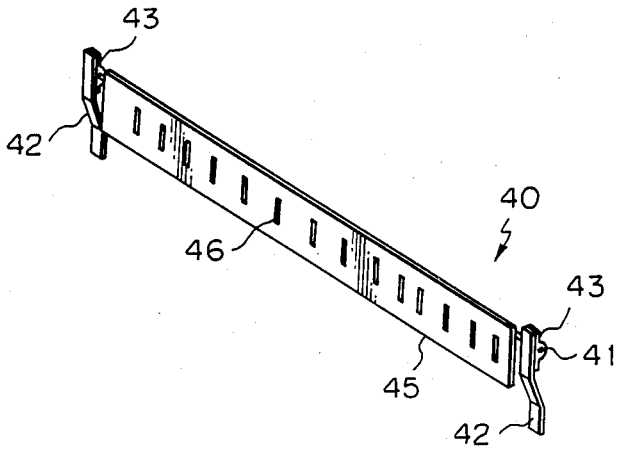
FIG. 2 is a perspective view of the muffler mechanism shown in FIG. 1
Figure 3:
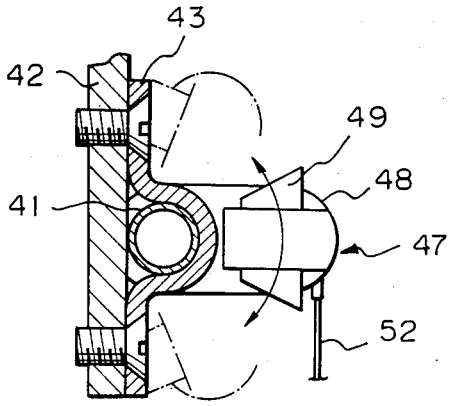
FIG. 3 is a side view, partly in section, of a sound generator unit associated with the muffler mechanism.

The muffler mechanism in accordance with the present invention is used in combination with the above-described damper assembly 30. As best seen in FIGS. 2 and 3, the muffler mechanism 40 includes a muffler pipe 41 which extends horizontally and laterally over all strings 7 at a position below the array of strings 7 and somewhat behind the hammer felts 18. Each end of the muffler pipe 41 is axially rotatably held by a bracket 43 via a support plate 42, the bracket 43 being secured to a middle section 44 of the plate 25. A muffler 45 made of a resilient material such as leather, felt or unwoven fabric is secured at the upper edge to the muffler pipe 41. A number of juxtaposed cutouts 46 may be formed in the muffler 45 and spaced between the neighbouring areas striken by hammers.

As shown in FIG. 3, one end of the muffler pipe 41 is associated with a sound generator unit 47 which includes a connector 48 securedly inserted over the end of the muffler pipe 41 and a magnet 49 held by the connector 48. As the muffler pipe 41 axially rotates, the magnet 49 abuts against the upper and lower faces of the bracket 43 to click as shown with chain lines. Attraction between the magnet 49 and the bracket 43 holds the rotated position of the muffler pipe 41 so that the muffler 45 should be registered at one of the two positions which are shown with solid and chain lines 45' in FIG. 1. For this switching, a switch knob 51 is coupled to the bottom of the key bed 1 via a bracket 50 and a spring 53. The connector 48 of the sound generator unit 40 is connected to this switch knob 51 by means of a wire 52 and repulsion of the spring 53 always pulls the switch knob 51 towards the connector 48. As a consequence, the magnet 49 is held in engagement with the upper face of the bracket 43 so that the muffler 45 is held at the solid line position for normal performance when the switch knob 51 is unoperated. For damped performance, the switch knob 51 is manually pulled forwards so that the connector 48 should rotate clockwise in FIG. 3 (counterclockwise in FIG. 1) and the muffler 45 should be registered at the chain line position 45' between the strings 7 and the hammer felts 18. On depression of a key 3 under this condition, an associated hammer shank 20 turns upwards by operation of the action assembly 6 to strike an associated string 7 via the muffler 45. Damping is caused by this indirect striking. Due to the magnetic attraction, the switch knob 51 is held at the pulled position.

Thus, switching between normal and damped performance can be easily carried out by simple operation on the switch knob 51. Since the switch knob 51 is connected to the connector 48 via an elongated wire 52, its position of mounting can be chosen quite freely. Since the muffler 45 is normally located behind the associated hammer, its presence does not interfere with adjustment and mounting of the action assembly 6. Switching can be acoustically confirmed by clicks generated by the sound generator unit 40 at every switching. Since the sound generator unit has function to maintain switched condition thanks to the magnetic attraction, no unexpected switching starts during performance.

Although a magnet 49 is used for the sound generating unit 40 in the case of the foregoing example, any different expedients may be employed as long as it generates sounds at switching and maintains switched conditions without unexpected switching. The sound generator unit 40 may be arranged near the switch knob 51.

Although a single muffler pipe 41 extends over all strings 7 in the case of the foregoing example, separate muffler pipes may be used for different string groups. Arrangement of the muffler pipe may be omitted for treble range strings. Proper flanges may be provided at positions along the length of a muffler pipe for mounting of mufflers. The cutouts 46 in the muffler 45 may be omitted by proper choice of material and thickness for the muffler 45.

In the case of the foregoing example, a switch knob 51 is connected to the connector 48 by means of a wire 52. A knee lever or a foot pedal may be used as a substitute for the switch knob 51 and such element may be directly connected to the muffler pipe 41. The wire 52 may also be replaced by a rod or link mechanism. Further, one end of the wire 52 may be connected to a rack which is in meshing engagement with a pinion secured to the muffler pipe 41. A link mechanism may be interposed in the transmission.

I claim:

1. A muffler mechanism for a piano, comprising;

at least one muffler pipe axially rotatably arranged below an array of strings and extending horizontally in the width direction of the piano;

a muffler coupled to the muffler pipe and movable, upon axial rotation of the muffler pipe, between an inoperative position for normal performance and an operative position for damper performance, the operative position being located between the array of strings and an associated array of hammers;

a means for driving the muffler pipe for the axial rotation in response to the manual operation of the driving means;

a sound generator unit which clicks upon the axial rotation of the muffler pipe, the sound generator unit includes a magnet mounted to the driving means for generating the clicking sound.

2. A muffler mechanism according to claim 1, wherein the driving means includes a connector coupled to the muffler pipe, a wire connected at one end to the connector and a hand operable switch knob coupled to the other end of the wire.

3. A muffler mechanism according to claim 2, wherein the magnet is mounted to the connector of the driving means.

4. A muffler mechanism according to claim 1, wherein the muffler pipe is arranged behind the array of the hammers.

5. A muffler mechanism for a piano, comprising:

at least one muffler pipe axially rotatably arranged below an array of strings and extending horizontally in the width direction of the piano;

a muffler coupled to the muffler pipe and movable, upon axial rotation of the muffler pipe, between an inoperative position for normal performance and an operative position for damper performance, the operative position being located between the array of strings and an associated array of hammers;

means for driving the muffler pipe for the axial rotation upon manual operation thereon; and magnetic means coupled to the driving means for selectively maintaining by magnetic attraction the muffler at the operative position.

6. A muffler mechanism according to claim 5, wherein the muffler pipe is arranged behind the array of the hammers.

7. A muffler mechanism according to claim 5, wherein the driving means includes a connector coupled to the muffler pipe, a wire connected at one end to the connector and a hand operable switch knob coupled to the other end of the wire.

8. A muffler mechanism according to claim 7, wherein the magnetic means includes a magnet mounted on the connector.

9. A muffler mechanism according to claim 5, further comprising a sound generator unit which clicks upon the axial rotation of the muffler pipe, the sound generator unit includes a magnet mounted to the driving means for generating the clicking sound.

10. A muffler mechanism according to claim 9, wherein the magnetic means includes the magnet of the sound generator unit whereby the magnet selectively maintains the muffler at the operative position and also generates the clicking sound upon axial rotation of the muffler pipe.

11. A muffler mechanism according to claim 5, wherein the magnetic means also selectively maintains by magnetic attraction the muffler at the inoperative position.

* * * * *